US007229306B2

(12) United States Patent
Mase et al.

(10) Patent No.: US 7,229,306 B2
(45) Date of Patent: Jun. 12, 2007

(54) CONNECTOR AND A CONNECTOR ASSEMBLY

(75) Inventors: Tsuyoshi Mase, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/431,352

(22) Filed: May 10, 2006

(65) Prior Publication Data

US 2006/0272364 A1 Dec. 7, 2006

(30) Foreign Application Priority Data

May 19, 2005 (JP) ..... 2005-146559
May 19, 2005 (JP) ..... 2005-146566

(51) Int. Cl.
*H01R 13/627* (2006.01)

(52) U.S. Cl. ..... 439/354

(58) Field of Classification Search ..... 439/354, 439/352, 358, 353, 489
See application file for complete search history.

(56) References Cited

U.S. PATENT DOCUMENTS 6,059,598 A 5/2000 Yamashita et al.
6,428,346 B1 8/2002 Torii
6,561,833 B2 5/2003 Saka et al.
6,821,024 B2 * 11/2004 Bates, III ..... 385/76
7,033,201 B2 4/2006 Ichida et al.
7,052,186 B1 * 5/2006 Bates ..... 385/59
2006/0134964 A1 * 6/2006 Ohtaka et al. ..... 439/358

FOREIGN PATENT DOCUMENTS

JP 04-322080 11/2004

* cited by examiner

*Primary Examiner*—Phuong Dinh
(74) *Attorney, Agent, or Firm*—Gerald E. Hespos; Anthony J. Casella

(57) ABSTRACT

A female housing (30) has a lock arm (40) and a resilient assisting piece (50). The assisting piece (50) is deformed by the lock arm (40) as the lock arm (40) is deformed. The assisting piece (50) is restored resiliently as the lock arm (40) resiliently restores and contributes to the resilient restoring force of the lock arm (40). Thus, the lock arm (40) produces a large hitting sound against the mating male housing (10). A hitting portion (52) is at the leading end of the assisting piece (50) and hits a hittable portion (27) on the mating male housing (10) to produce a separate hitting sound. Thus, two separate or simultaneous hitting sounds are produced to provide a clear audible and tactile indication of connection.

19 Claims, 20 Drawing Sheets

CONNECTOR AND A CONNECTOR ASSEMBLY

BACKGROUND OF THE INVENTION

1. Field of the Invention

The invention relates to a connector assembly with a function of locking a pair of housings in a properly connected state.

2. Description of the Related Art

Japanese Unexamined Patent Publication No. H04-322080 discloses a connector assembly with first and second housings. A resiliently deformable lock arm is formed on the first housing and a projection is formed on the lock arm. A locking hole is formed in an inner wall of the second housing. The projection moves onto the inner wall of the second housing in the process of connecting the two housings and resiliently deforms the lock arm. However, the projection aligns with the lock hole when the housings are connected properly. Thus, the lock arm is restored resiliently and the projection fits into the locking hole to lock the housings in a properly connected state.

The lock arm hits the inner wall of the mating housing with force when the lock arm is restored resiliently and makes a clicking sound. The sound assures the operator that locking has been effected. However, a small connector has a small lock arm that exhibits a small resilient restoring force and a low hitting noise. Thus, it is difficult to determine that locking has been completed, particularly if connection is carried out in a high noise environment.

The invention was developed in view of the above problem and an object thereof is to enable a judgment to be more securely made as to whether or not locking has been properly effected.

SUMMARY OF THE INVENTION

The invention relates to a connector with a housing that is connectable with a mating housing. A resiliently deformable lock arm is provided in the housing and is deformed in the process of connecting the housing with the mating housing. However, the lock arm is restored resiliently at a specified connection position. The restored lock arm hits the mating housing and engages an engaging portion in the mating housing to effect locking. At least one resilient assisting piece is provided in one of the housings and deforms as the lock arm is deformed. The assisting piece is restored resiliently together with the lock arm and hits a mating hittable portion.

The restoring force of the assisting piece contributes to the restoring force of the lock arm and causes the lock arm to produce a larger hitting sound. Additionally, the hitting sound of the assisting piece against the mating hittable portion is added to the hitting sound produced by the lock arm. Thus, a large hitting sound is obtained to provide a clear indication of locking.

The resilient assisting piece preferably hits the mating hittable portion substantially when the lock arm hits against the mating housing.

The resilient assisting piece preferably is in the housing and the hittable portion is provided in the mating housing.

An interlocking mechanism for the resilient deformations is made simple by providing the assisting piece on the same housing as the lock arm. Further, the provision of the assisting piece on the same housing as the lock arm necessarily requires the hittable portion to be on the mating housing. Hence, there is no need for a separate hittable portion on the housing that has the lock arm, and the entire connector assembly can be simpler and smaller.

The resilient assisting piece preferably is substantially U-shaped, and has two arms that extend from opposite ends of a hitting portion. The arms preferably are cantilevered and extend along the lateral edges of the lock arm.

Two partition walls preferably are provided on one of the housings. The lock arm and/or the assisting resilient piece preferably are provided at least partly between the partition walls.

In an alternate embodiment, the assisting piece is configured to hit the mating housing before or after the lock arm hits the mating housing. Thus, two consecutive hitting sounds are generated. Two consecutive hitting sounds are more distinctive than a single hitting sound, particularly in a loud environment. Thus, an operator can determine more definitively that locking has been effected.

A hittable portion to be hit by the lock arm and a hittable portion to be hit by the assisting piece preferably project different distances from a wall of the mating housing. The timing of the hits can be controlled merely by varying the heights of the respective hittable portions.

A plurality of independent assisting pieces may be provided and can hit the mating housing at different times. Thus, three or more consecutive hitting sounds can be produced for an even clearer indication of locking.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1A:
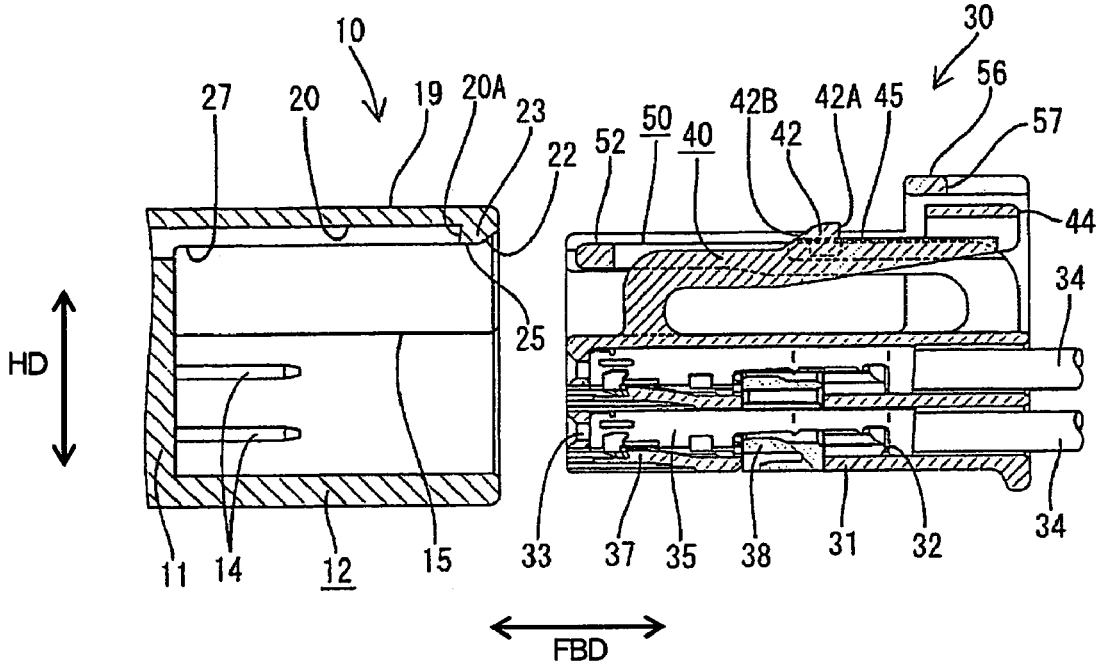
FIGS. 1(A) and 1(B) are longitudinal sections showing male and female housings of a first embodiment of the invention prior to connection.
Figure 1B:
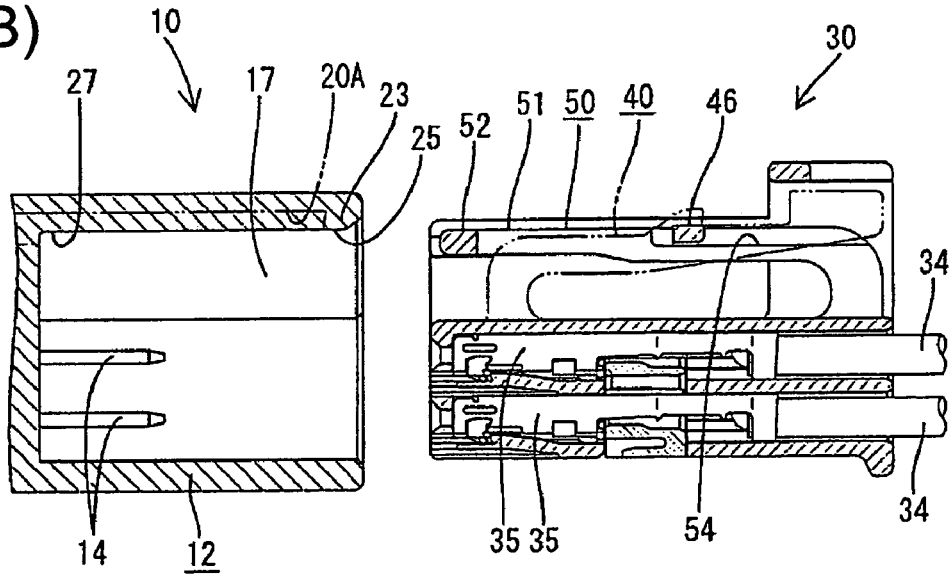

A connector according to a first embodiment of the invention is illustrated in FIGS. 1 to 7. The connector includes a male housing 10 and a female housing 30 that are connectable with each other as shown in FIG. 1. In the following description, ends of the housings 10, 30 that are to be connected are referred to as the front ends.

Figure 2:
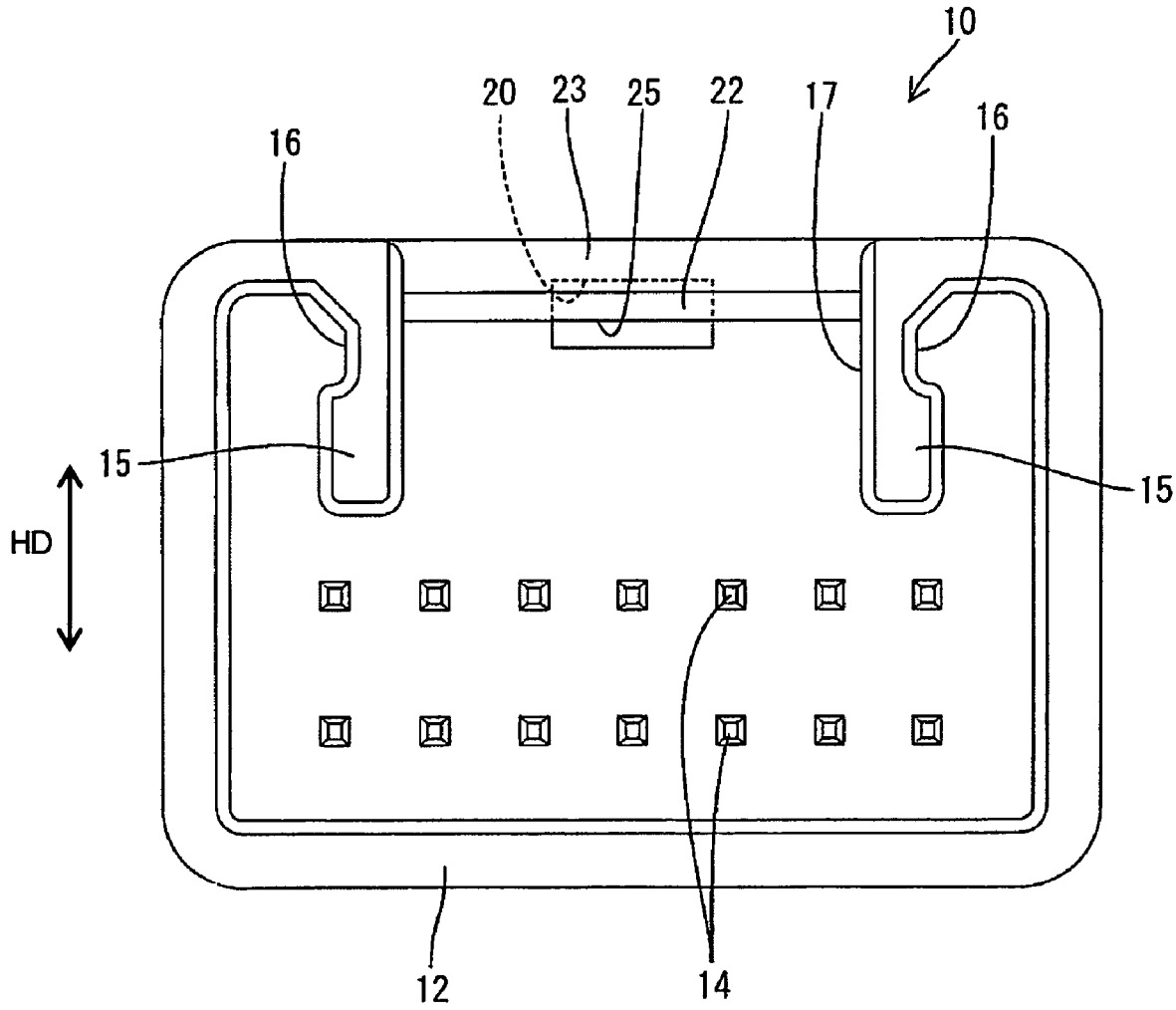
FIG. 2 is a front view of the male housing.

The male housing 10 projects integrally from a side wall 11 of a casing of a piece of equipment. The casing and the male housing 10 are formed from a synthetic resin. The male housing 10 includes a rectangular tubular receptacle 12, as shown in FIG. 2. Tab-shaped male terminals 14 project from the back of the receptacle 12 and are arranged at upper and lower stages.

Left and right partition walls 15 project in from the ceiling of the receptacle 12 at positions near the opposite left and right sides. The inner or bottom edges of the partition wall 15 are at substantially center positions of the receptacle 12 with respect to the height direction HD and extend over substantially the entire depth of the receptacle 12.

Hook-shaped guiding grooves 16 are formed at the outer sides of the left and right partition walls 15. The guiding grooves 16 extend in forward and backward directions FBD and substantially face each other. An entrance space 17 is defined in an area between the two partition walls 15.

Figure 3:
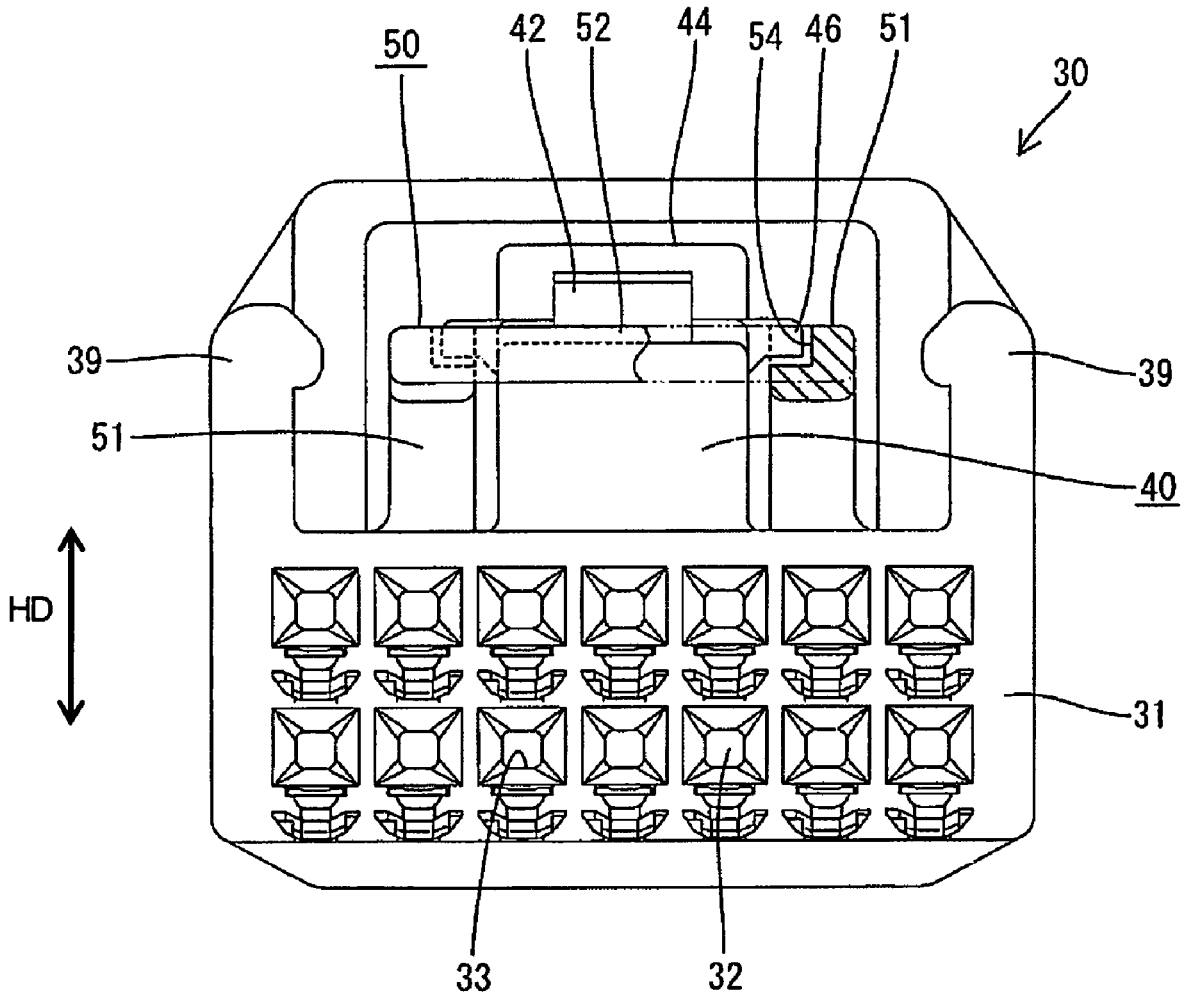
FIG. 3 is a front view partly in section of the female housing.
Figure 4:
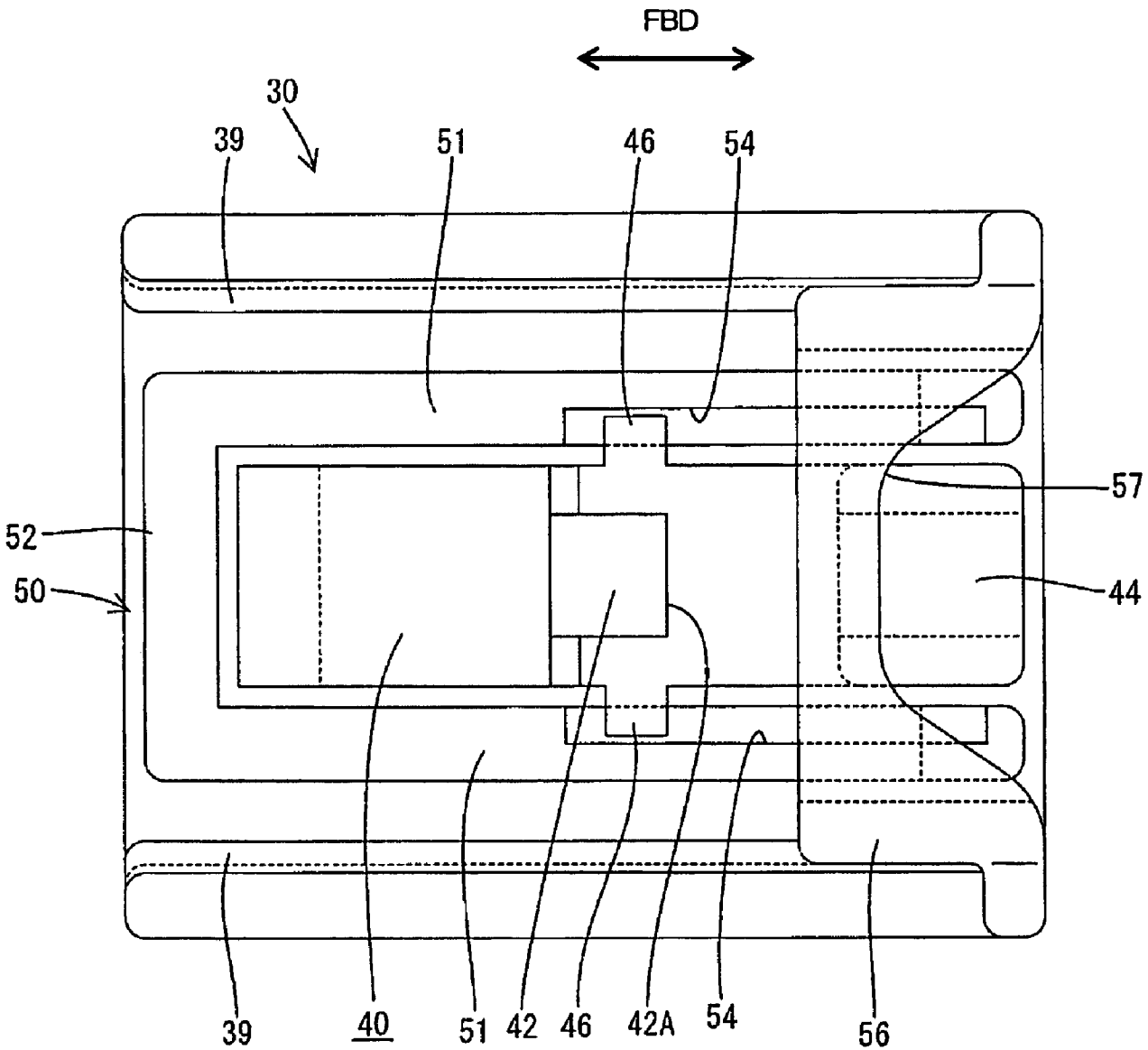
FIG. 4 is a plan view of the female housing.
Figure 5:
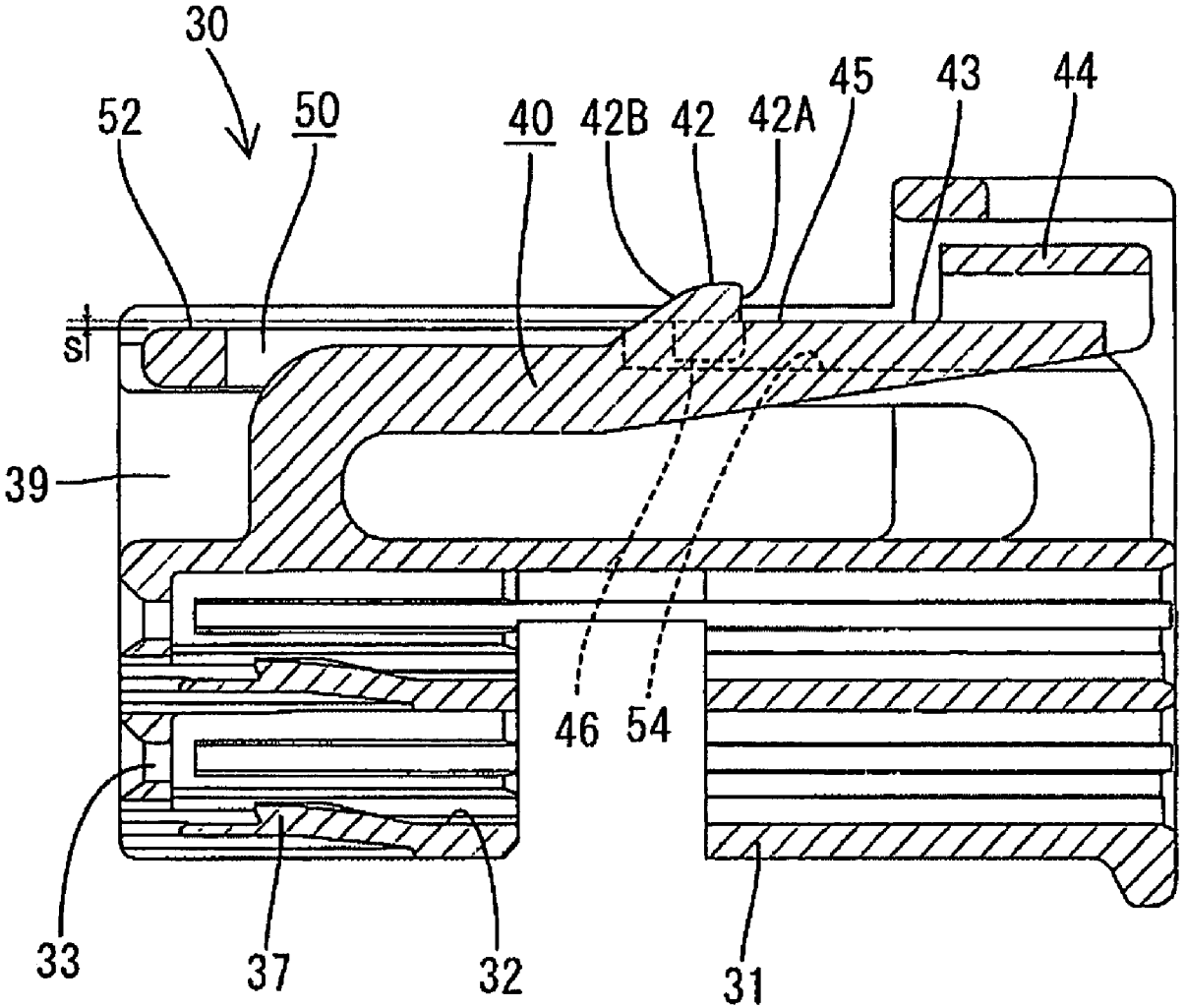
FIG. 5 is a longitudinal section of the female housing.

The female housing 30 also is made of a synthetic resin and includes a block-shaped main body 31 that is closely fittable into a lower area of the receptacle 12 of the male housing 10 below and adjacent the bottom ends of the partition walls 15, as shown in FIGS. 3 to 5. Cavities 32 are arranged at upper and lower stages in the main body 31 at positions corresponding to the male terminals 14. The cavities 32 extend in forward and backward directions FBD. A terminal insertion opening 33 is formed in the front surface of each cavity 32 for permitting insertion of the respective male terminal 14.

A female terminal 35 secured to an end of a wire 34 is inserted into each cavity 32 from behind, and is locked partly by a lock 37 formed at the bottom wall of the cavity 32. The female terminals 35 then are locked doubly by a retainer 38 inserted from below.

Hook-shaped guiding ribs 39 project up from the upper surface of the male body at positions near the left and right sides. The guiding ribs 39 are disposed and configured to fit closely into the guiding grooves 16 of the male housing 10.

A lock arm 40 is formed at a substantially widthwise middle position of the upper surface of the main body 31 of the female housing 30. The lock arm 40 preferably is less than half as wide as the female housing 30 and more preferably slightly less than about one third as wide as the female housing 30. Additionally, the lock arm 40 stands up at a position slightly behind the front end of the upper surface of the main body 31 and is cantilevered substantially horizontally rearward to the vicinity of the rear end of the upper surface of the main body 31. An extending end of the lock arm 40 is resiliently deformable up and down towards and away from the housing 30 with the base end as a support.

A projection 42 is formed in substantially the longitudinal center of the upper surface of the lock arm 40. An engaging surface 42A is formed at the rear of the projection 42 and extends substantially upright and normal to the lock arm 40. A guiding surface 42B is formed at the front of the projection 42 and inclines down towards the front. The upper surface of the lock arm 40 has a stepped diverging shape so that an elevated surface 43 is defined at the rear end and is slightly higher than the front end.

An operable portion 44 is formed at the extending end of the lock arm 40 and is used to forcibly deform the lock arm 40 for unlocking.

A lock groove 20 is formed substantially in the widthwise center of the inner surface upper wall 19 of the entrance space 17 of the receptacle 12 of the male housing 10, as shown in FIG. 1. The lock groove 20 is disposed for receiving the projection 42 of the lock arm 40 and extends back from a position at a specified distance from the front end of the upper wall 19. An overhanging or undercut locking surface 20A is formed at the front surface of the lock groove 20 and faces the engaging surface 42A of the projection 42. Further, a slanted guiding surface 22 is formed at a lower corner of the front surface of the upper wall 19.

The female housing 30 can be fit into the receptacle 12 of the male housing 10, as described in detail later. Thus, the guiding surface 42B of the projection 42 contacts the guiding surface 22 on the front surface of the upper wall 19. As a result, the lock arm 40 is pushed and deforms resiliently (see FIG. 6(A)). The projection 42 passes the lower surface of a front portion 23 of the lock groove 20 when the female housing 30 is fit to a specified position. Thus, the lock arm 40 restores towards its initial posture (see FIG. 7(A)) and the projection 42 engages the front end of the lock groove 20 to effect locking. Simultaneously, or in close time relationship, a first hitting portion 45 on the elevated surface 43 of the upper surface of the lock arm 40 near the projection 42 hits a first hittable portion 25 on the lower surface of the front portion 23 of the lock groove 20.

A resilient assisting piece 50 is provided on the female housing 30 for assisting restoration of the lock arm 40. The assisting piece 50 has left and right arms 51 that stand up from the left and right sides of the extending end of the lock arm 40 at the rear end of the upper surface of the main body 31. The left and right arms 51 then extend substantially horizontally along the left and right sides of the lock arm 40 beyond the base end of the lock arm 40 and to the front end of the upper surface of the main body 31. The extending ends of the arms 51 are coupled by a second hitting portion 52 so that the assisting piece 50 is substantially U-shaped.

The resilient assisting piece 50 has a width to permit insertion between the two partition walls 15 of the male housing 10.

This assisting piece 50 is formed so that the second hitting portion 52 is resiliently deformable substantially up and down with the base ends of the arms 51 as supports. Deformation of the assisting piece 50 is interlocked with the deformation of the lock arm 40. More particularly, pressing portions 46 bulge out from the left and right surfaces of the lock arm 40 at a position near the projection 42. Pressable grooves 54 are formed in the inner surfaces of the arms 51 of the assisting piece 50 for receiving the pressing portions 46. Thus, the pressing portions 46 can press the bottoms of the pressable grooves 54.

Specifically, the pressing portions 46 press the bottoms of the pressable grooves 54 when the lock arm 40 is deformed resiliently, as described above. Thus, the assisting piece 50 is deformed resiliently in a lowering direction of the second hitting portion 52 (see FIG. 6(B)). The lock arm 40 and the assisting piece 50 restore resiliently towards their initial postures substantially simultaneously (see FIG. 7(B)). At this time, the second hitting portion 52 of the assisting piece 50 hits the second hittable portion 27 at the inner surface of the back side of the upper wall 19 of the receptacle 12 of the male housing 10. Accordingly, the first and second hitting portions 45, 52 and the first and second hittable portions 25, 27 are displaced longitudinally along the forward and backward directions FBD.

The second hitting portion 52 of the assisting piece 50 preferably hits the second hittable portion 27 when the first hitting portion 45 of the lock arm 40 hits the first hittable portion 25. Thus, in this embodiment, the first hittable portion 25 for the lock arm 40 and the second hittable portion 27 for the assisting resilient piece 50 are at substantially the same heights, as shown in FIG. 1(A). However, the first hitting portion 45 of the lock arm 40 is higher than the second hitting portion 52 of the assisting resilient piece 50 by a specified distance "s", as shown in FIG. 5, for the following reason. Specifically, slight clearances are defined between the pressing portions 46 and the bottoms of the pressable grooves 54 because of molding. The interlocked deformations of the lock arm 40 and the assisting piece 50 start when the lock arm 40 is deformed slightly from its initial posture and the pressing portions 46 contact the bottoms of the pressable grooves 54. Conversely, the lock arm 40 still is deformed slightly when the assisting piece 50 returns to its initial posture. Accordingly, for the lock arm 40 and the assisting piece 50 to hit the respective hittable portions 25, 27 substantially simultaneously and at substantially the same height, the first hitting portion 45 of the lock arm 40 must be higher because the lock arm 40 still is deformed.

A substantially arch-shaped protection wall 56 is formed at the rear end of the upper surface of the main body 31 of the female housing 30 and at least partly covers the operable portion 44 of the lock arm 40 and the base end of the assisting piece 50. The protection wall 56 prevents external matter from inadvertently contact the operable portion 44 of the lock arm 40 and prevents the wires 34 from entering below the operable portion 44. An opening 57 is made in the upper surface of the protection wall 56 to enable the operable portion 44 to be pressed.

The guiding ribs 39 and the guiding grooves 16 guide the lock arm 40 and the assisting piece 50 substantially straight into the entrance space 17 of the receptacle 12 as the female housing 30 is fit into the receptacle 12 of the male housing 10 in the state shown in FIG. 1. Simultaneously, the male terminals 14 pass through the terminal insertion openings 33 and into the cavities 32 for connection with the corresponding female terminals 35.

Figure 6A:
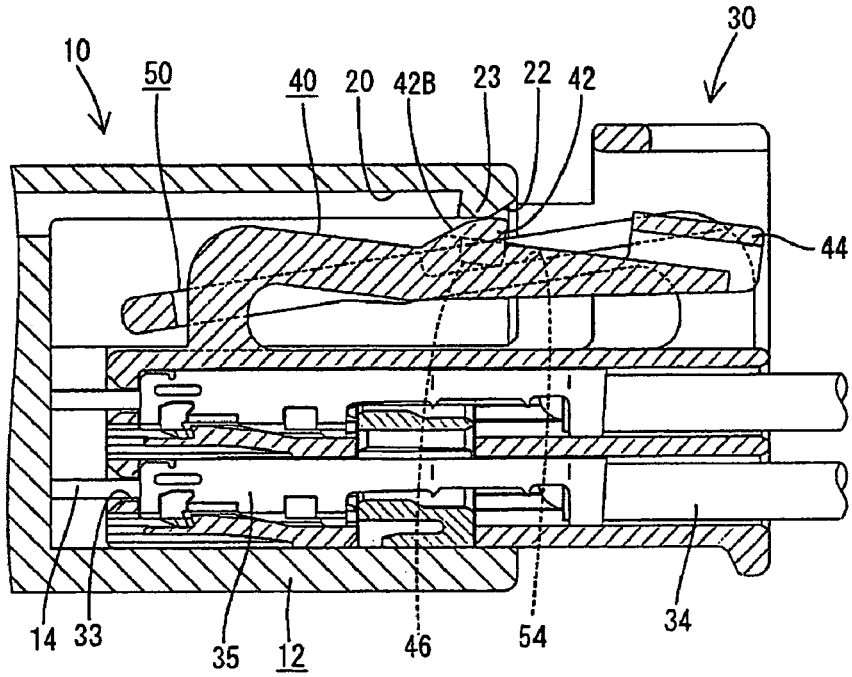
FIGS. 6(A) and 6(B) are longitudinal sections showing an intermediate state during a connecting operation of the two housings.

The guiding surface 42B of the projection 42 of the lock arm 40 contacts the guiding surface 22 on the front of the upper wall 19 of the male housing 10 towards the final stage of the connecting operation, as shown in FIG. 6(A). The projection 42 moves onto the lower surface of the front portion 23 of the lock groove 20 when the housings 10, 30 are connected further. Thus, the lock arm 40 is pushed while the side of the operable portion 44 is deformed down.

Figure 6B:
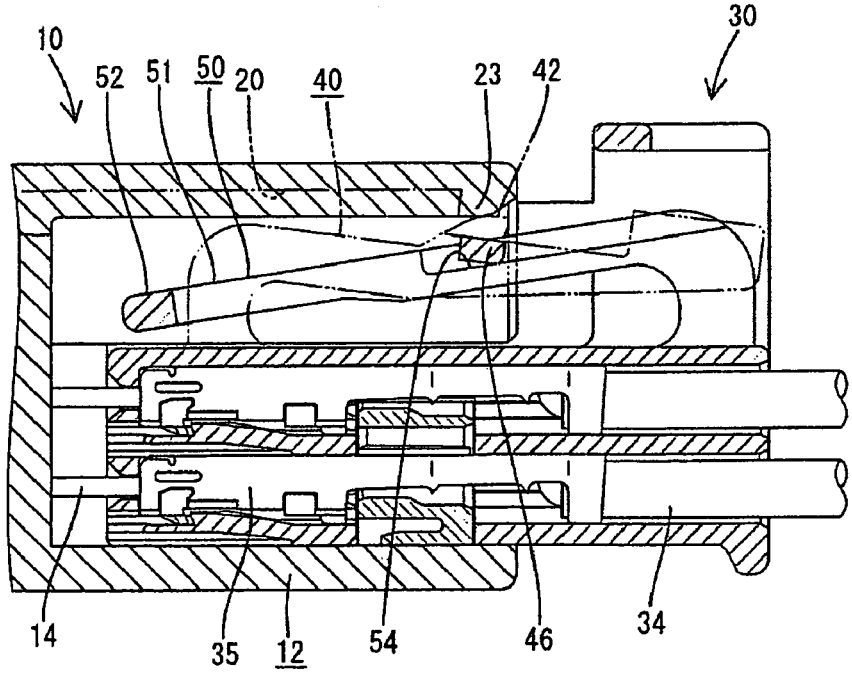

The pressing portions 46 of the lock arm 40 press the bottoms of the pressable grooves 54 in the respective arms 51 of the assisting piece 50, when the lock arm 40 is deformed resiliently as shown in FIG. 6(B). The assisting piece 50 is deformed resiliently in a direction to lower the second hitting portion 52 away from the corresponding portion of the housing 10.

Figure 7A:
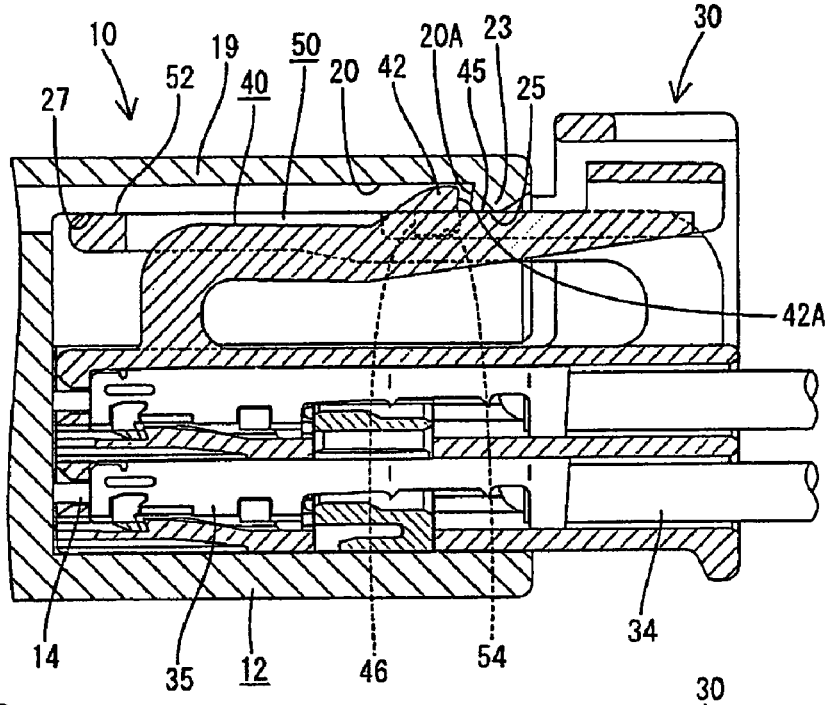
FIGS. 7(A) and 7(B) are longitudinal sections showing a state when the connecting operation is completed.
Figure 7B:
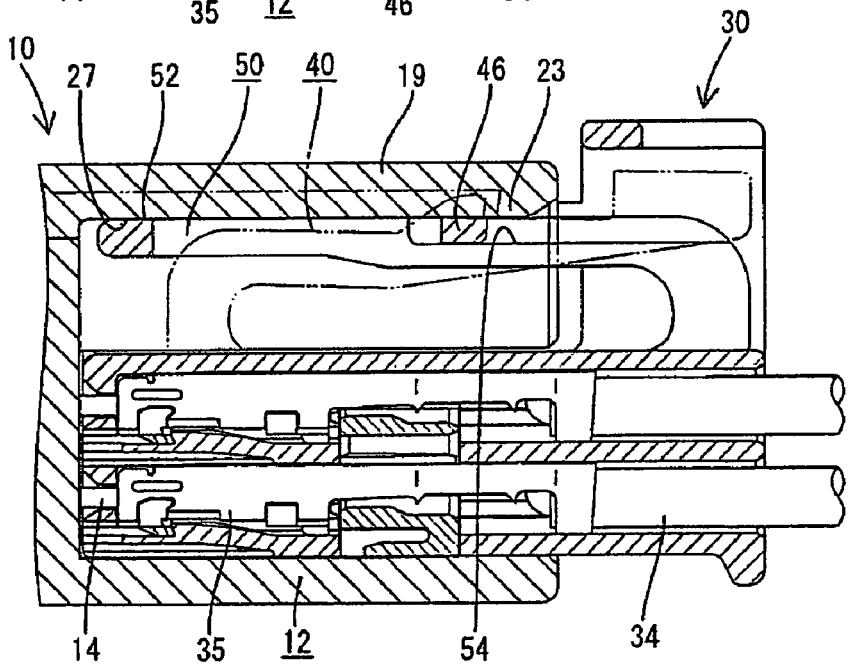

The projection 42 of the lock arm 40 passes the lower surface of the front portion 23 when the main body 31 of the female housing 30 reaches the back of the receptacle 12 and when corresponding male and female terminals 14, 35 are connected properly, as shown in FIGS. 7(A) and 7(B). Thus, the lock arm 40 is restored by its own resilient restoring force and a resilient restoring force of the assisting piece 50 and is fit into the lock groove 20 to effect locking.

At this time, the first hitting portion 45 of the lock arm 40 and the second hitting portion 52 of the assisting piece 50 substantially simultaneously hit the first and second hittable portions 25 and 27 of the mating male housing 10 to produce hitting sounds.

Specifically, the lock arm 40 is restored by its own resilient restoring force plus the resilient restoring force of the assisting piece 50. Thus, the lock arm 40 produces a large hitting sound. Furthermore, the assisting piece 50 produces its own hitting sound. Therefore, an operator can hear the hitting sound even in a loud environment, and can judge whether locking has been effected.

On some occasions the hitting sounds of the lock arm 40 and the assisting piece 50 may not be given out simultaneously due to a molding error or the like. However, two hitting sounds with a slight delay can be understood as one hitting sound.

In this embodiment, the construction including the interlocking mechanism can be simpler by providing the assisting piece 50 in the female housing 30 having the lock arm 40. Further, the mating male housing 10 has the second hittable portion 27 by the assisting resilient piece 50. Thus the female housing 30 is not enlarged as compared to a case where the second hittable portion 27 is in the female housing 30. As a result, the entire connector can have a compact construction.

A second embodiment of the invention is described with reference to FIGS. 8 to 15. The connector of the second embodiment has male and female housings 10 and 30 that are connectable with each other as shown in FIG. 8.

The male and female housings 10 and 30 of the second embodiment are similar to the male and female housings 10 and 30 of the first embodiment. Parts of the male and female housings 10 and 30 of the second embodiment that correspond to the first embodiment have been identified by the same reference numerals, and are not described again.

In this embodiment, the second hitting portion 52 of the resilient assisting piece 50 hits the mating hittable portion a specified time before the first hitting portion 45 of the lock arm 40 hits the first hittable portion 25.

Figure 8A:
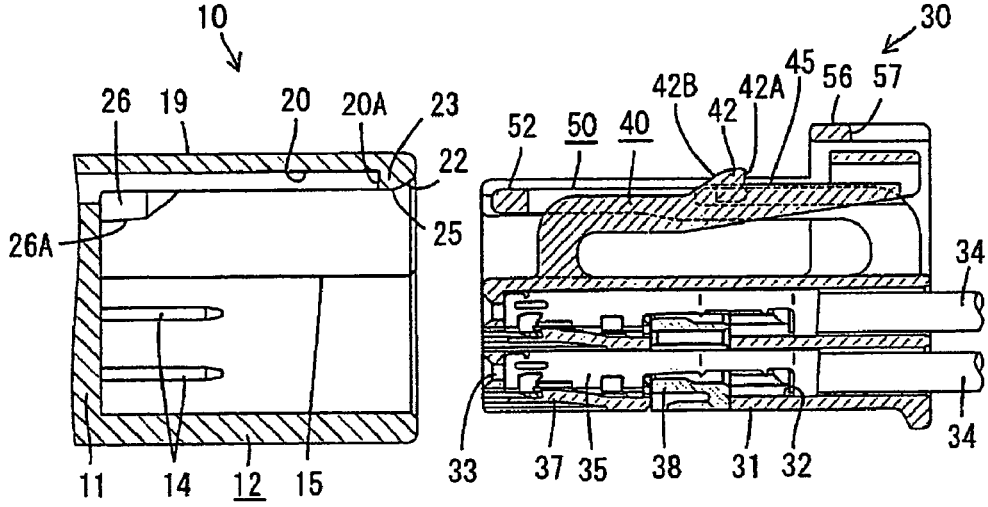
FIGS. 8(A) and 8(B) are longitudinal sections showing the male and female housings of the first embodiment of the invention prior to connection.
Figure 8B:
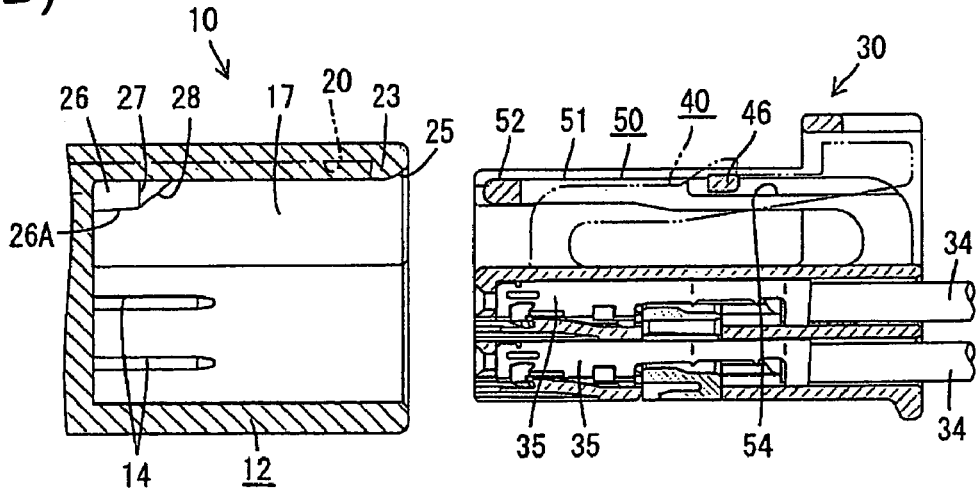
Figure 9:
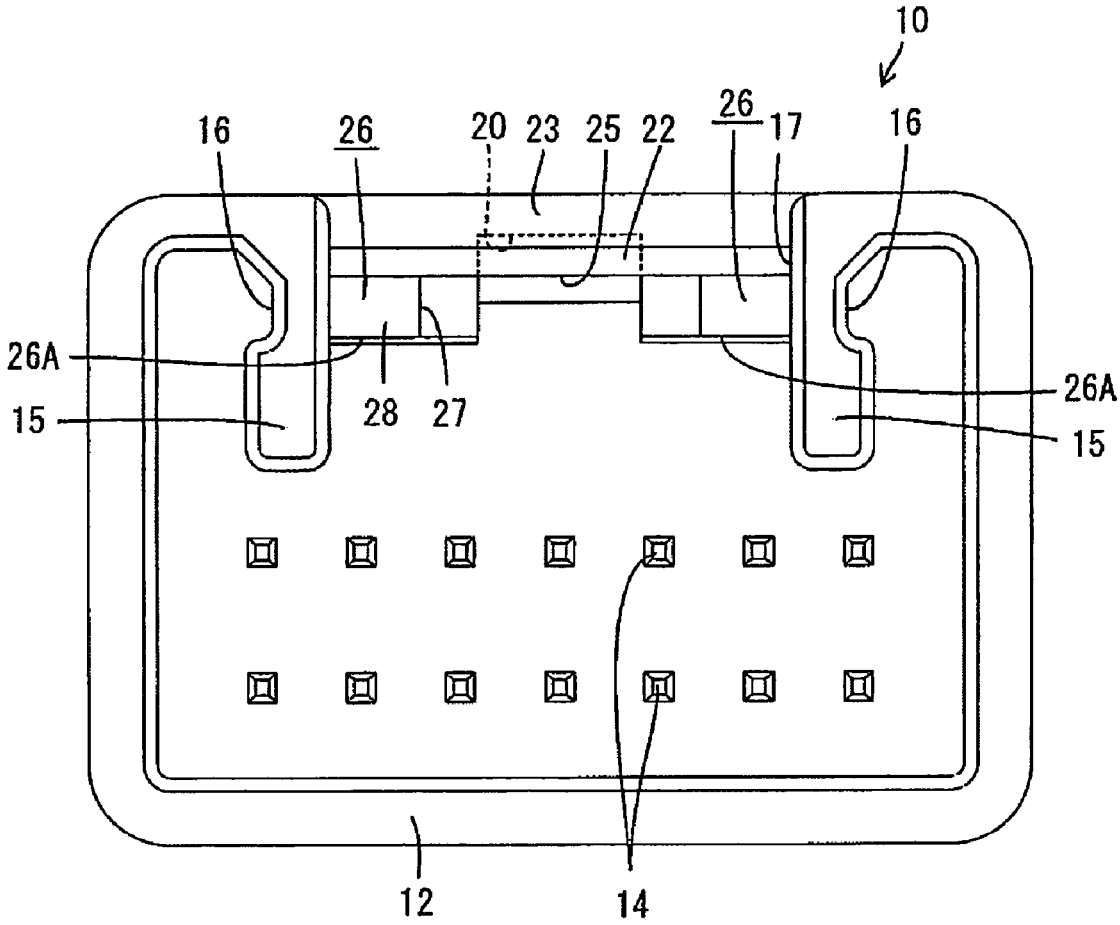
FIG. 9 is a front view of the male housing.
Figure 10:
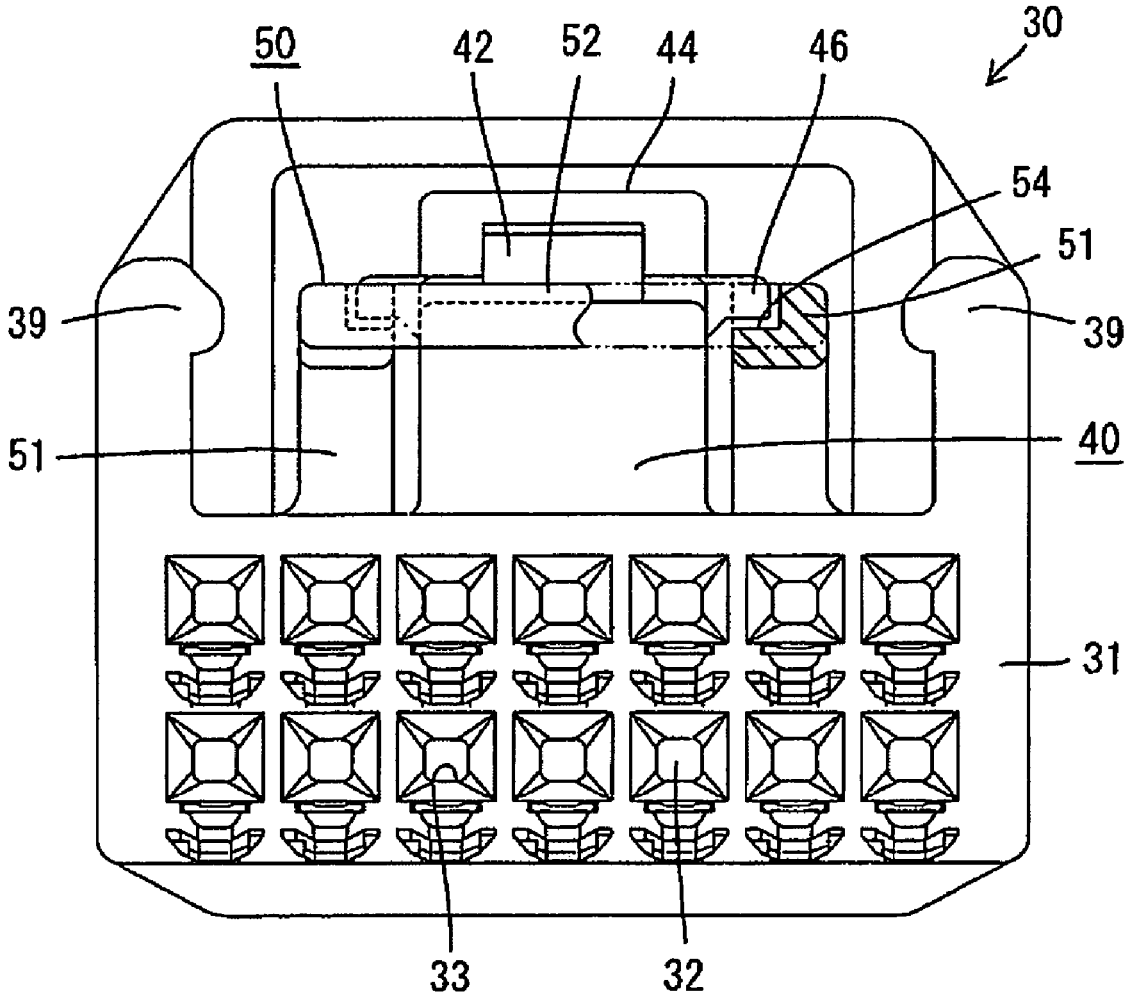
FIG. 10 is a front view partly in section of the female housing.
Figure 11:
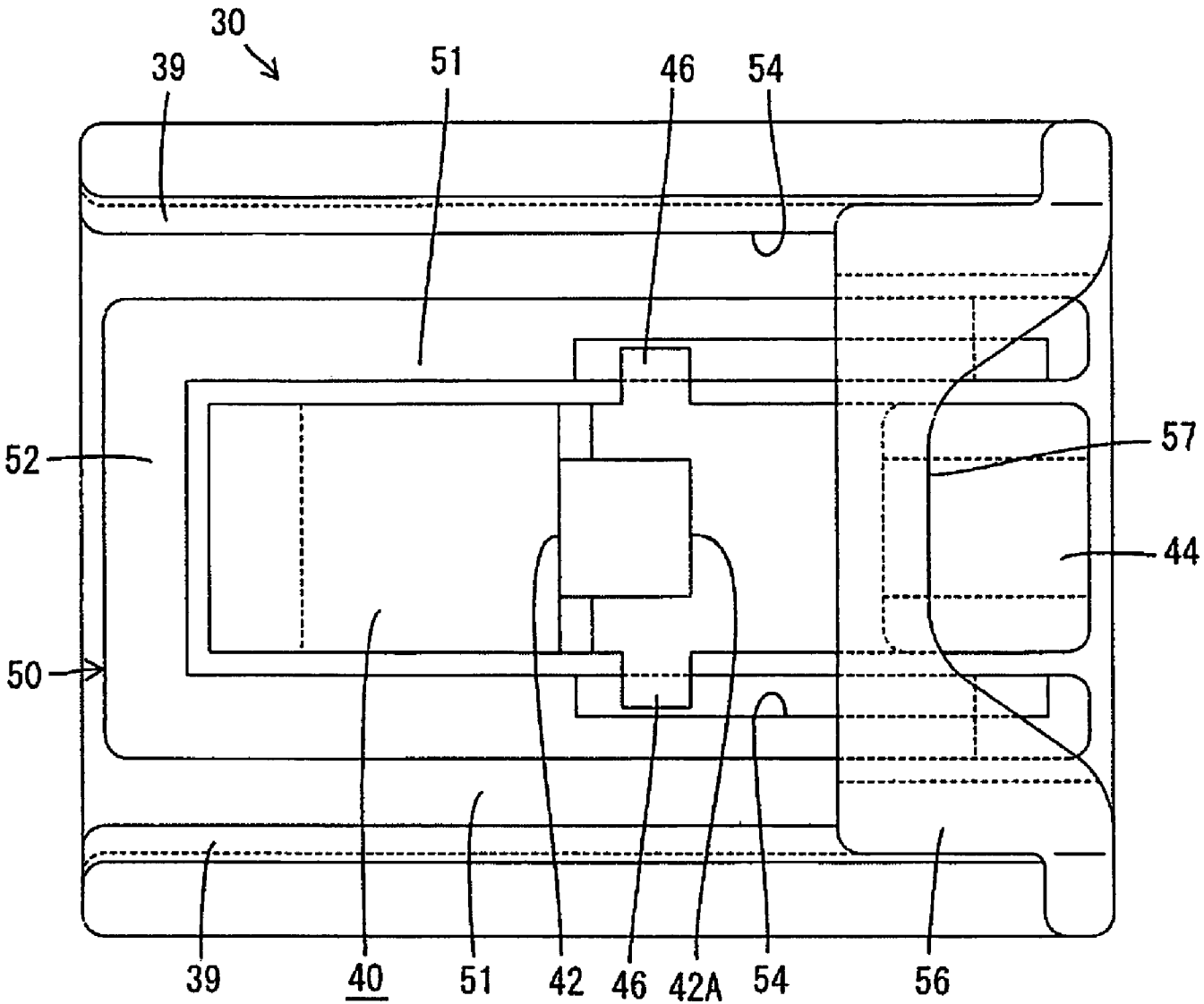
FIG. 11 is a plan view of the female housing.
Figure 12:
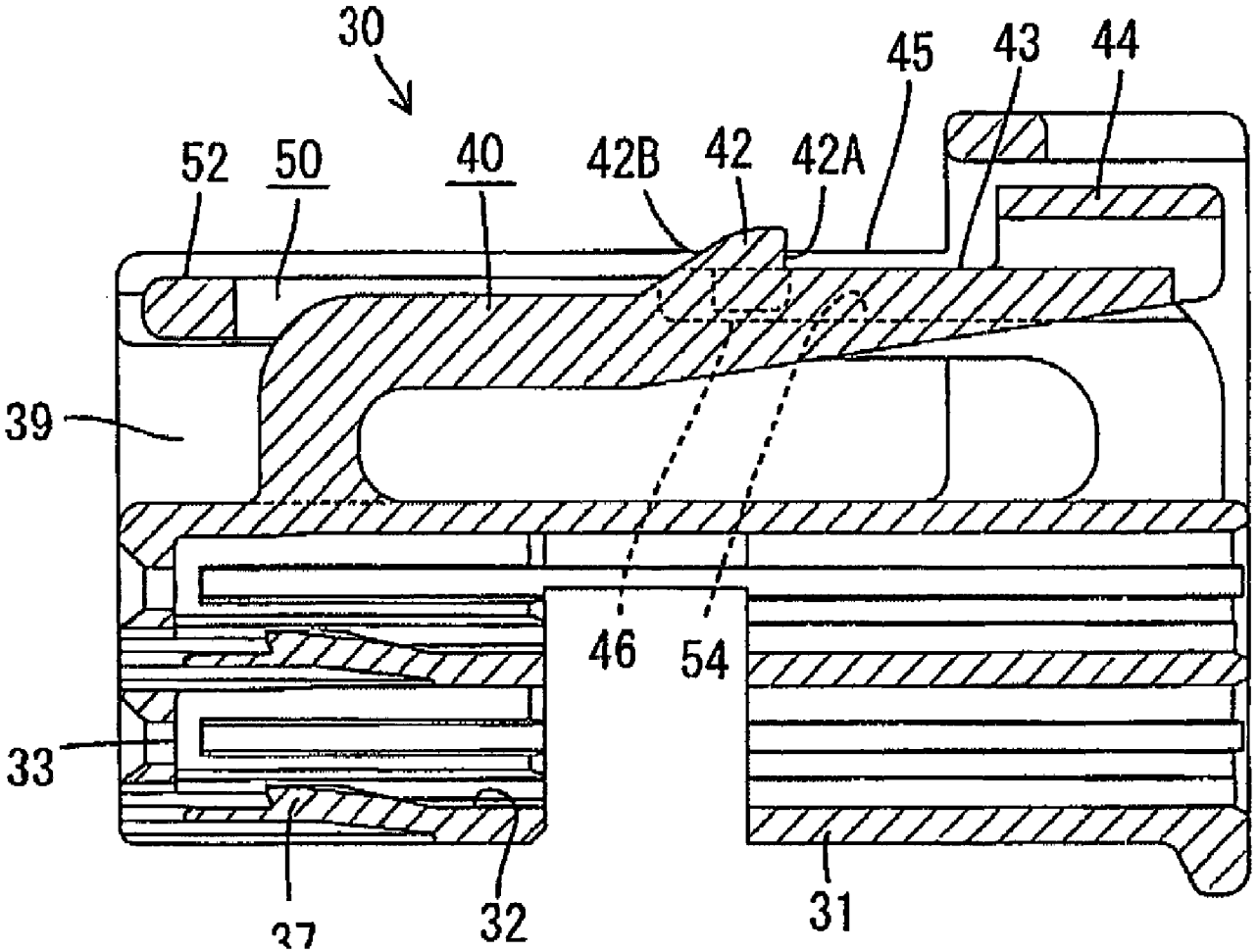
FIG. 12 is a longitudinal section of the female housing.

Accordingly, in this embodiment, two second hittable portions 26 project from the inner surface of the back side of the upper wall 19 of the entrance space 17 at the opposite left and right sides of the lock groove 20 as shown in FIGS. 8 and 9. Hittable surfaces 26A are defined on the second hittable portions 26 and are disposed to be hit by the opposite left and right ends of a second hitting portion 52 of the assisting piece 50. The hittable surfaces 26A are a specified distance lower than the first hitting portion 25, for example, at positions away from the inner surface of the inner upper wall 19 by more than about 1.3 times, more preferably about 1.5 times the depth of the lock groove 20. When the second hitting portion 52 of the assisting piece 50 hits the second hittable portions 26, the assisting piece 50 is inclined slightly down towards the leading end thereof immediately before returning towards its initial posture.

Therefore, the hittable surfaces 26A are inclined slightly down towards the back and are brought substantially into surface contact with the hitting portion 52.

Notches 27 are formed in inner areas of the front surfaces of the second hittable portions 26 to let the base end of the lock arm 40 escape. Additionally, outer areas of the second hittable portions 26 have slanted surfaces 28 to avoid interference with the second hitting portion 52 of the assisting resilient piece 50 before the resilient deformation.

The guiding ribs 39 and the guiding grooves 16 guide the lock arm 40 and the assisting piece 50 substantially straight into the entrance space 17 of the receptacle 12 as the female housing 30 is fit into the receptacle 12 of the male housing 10 in the state shown in FIG. 8. Simultaneously, the male terminals 14 pass through the terminal insertion openings 33 and into the cavities 32 for connection with the corresponding female terminals 35.

Figure 13A:
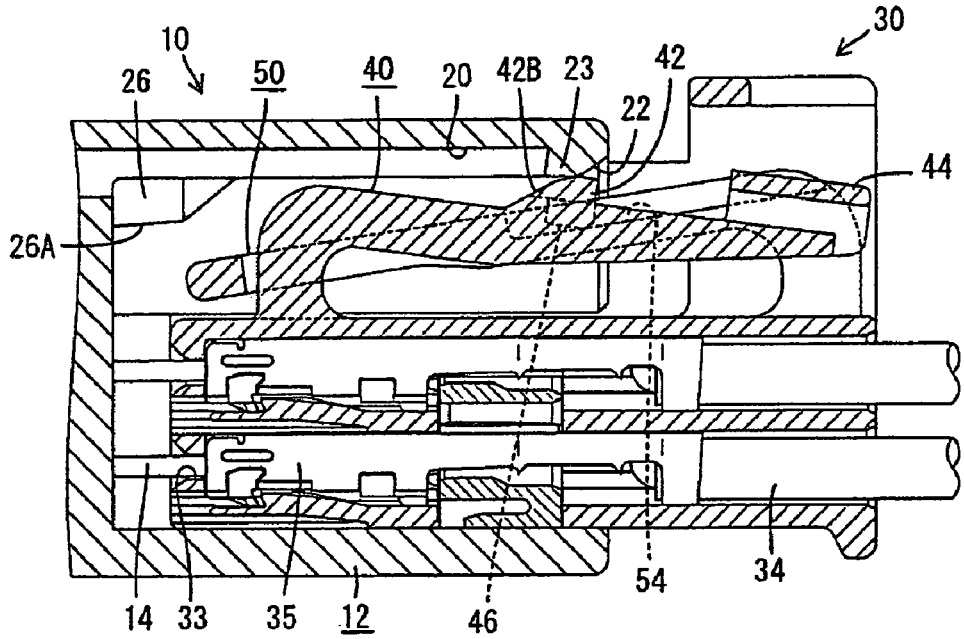
FIGS. 13(A) and 13(B) are longitudinal sections showing an intermediate state during a connecting operation of the two housings.

The guiding surface 42B of the projection 42 of the lock arm 40 contacts the guiding surface 22 on the front of the upper wall 19 of the male housing 10 towards the final stage of the connecting operation, as shown in FIG. 13(A). The projection 42 moves onto the lower surface of the front portion 23 of the lock groove 20 when the housings 10, 30 are connected further. Thus, the lock arm 40 is pushed while the side of the operable portion 44 is deformed down.

Figure 13B:
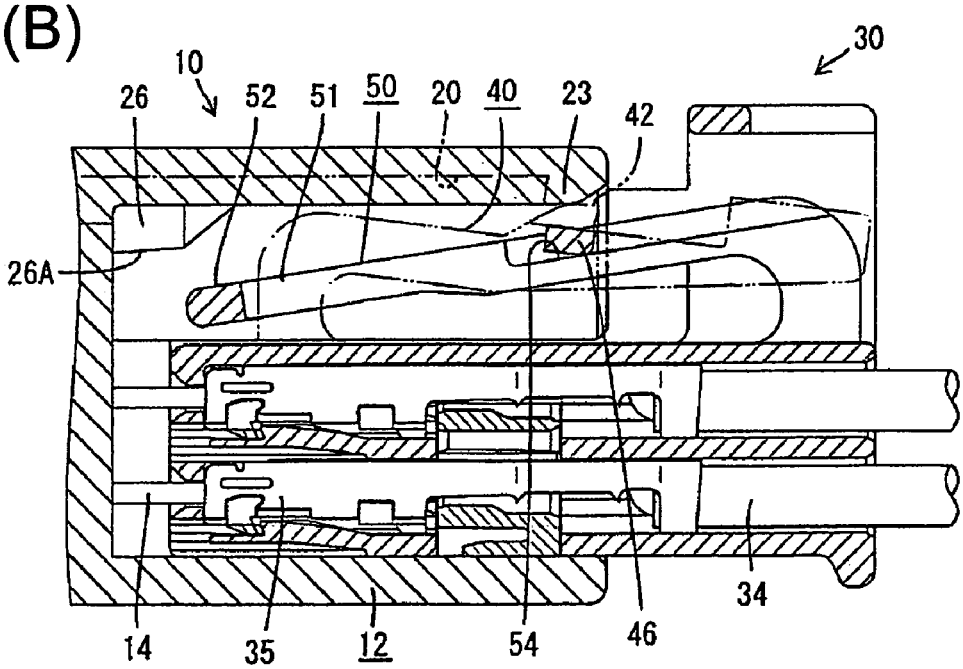

The pressing portions 46 of the lock arm 40 press the bottoms of the pressable grooves 54 in the respective arms 51 of the assisting piece 50, when the lock arm 40 is deformed resiliently as shown in FIG. 13(B). The assisting piece 50 is deformed resiliently in a direction to lower the second hitting portion 52 away from the corresponding portion of the housing 10.

The projection 42 of the lock arm 40 passes the lower surface of the front portion 23 when the main body 31 of the female housing 30 reaches a properly connected state at the back of the receptacle 12 and when the corresponding male and female terminals 14 and 35 are connected properly. As a result, the lock arm 40 and the assisting piece 50 are restored resiliently towards their initial postures.

Figure 14A:
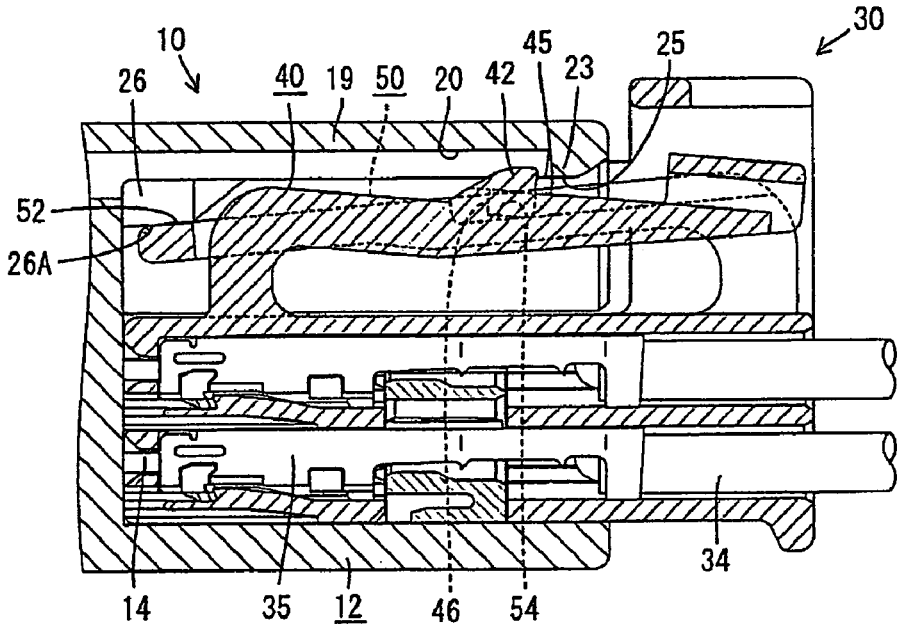
FIGS. 14(A) and 14(B) are longitudinal sections showing a state when the first hitting sound is created.
Figure 14B:
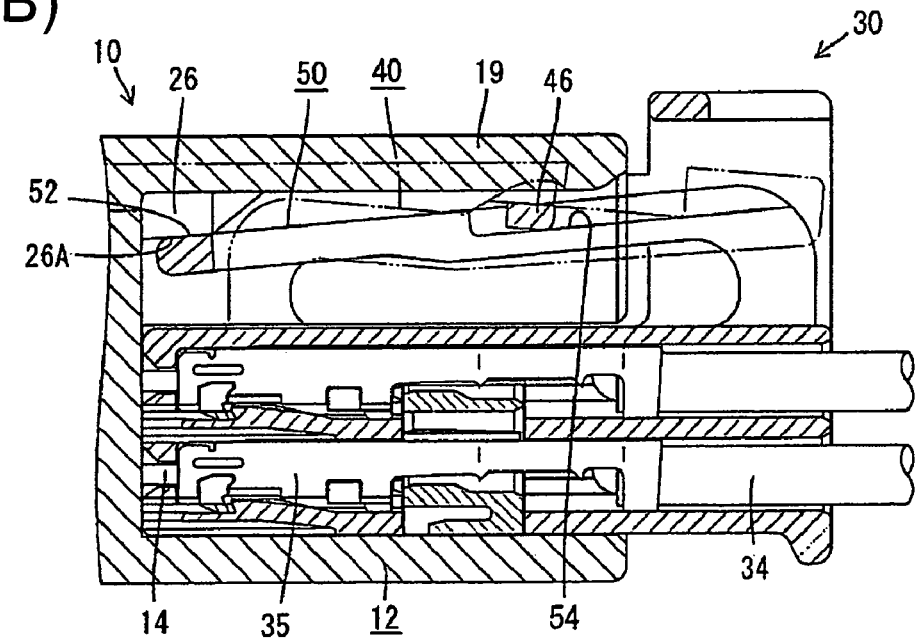

Then, as shown in FIGS. 14(A) and 14(B), the second hitting portion 52 of the assisting piece 50 hits the hittable surfaces 26A of the second hittable portions 26 at the lower positions to produce the first hitting sound.

Figure 15A:
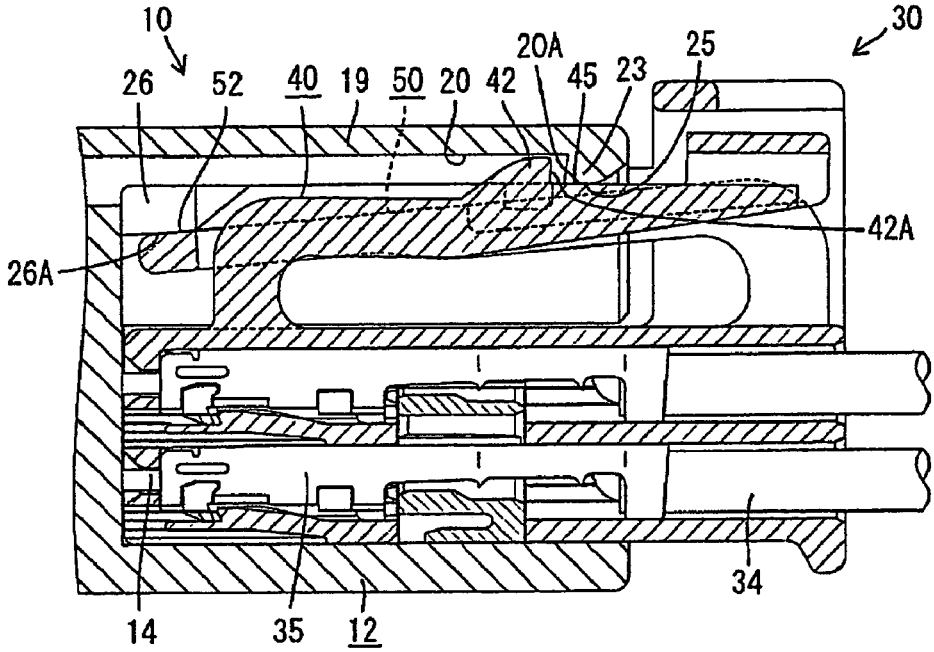
FIGS. 15(A) and 15(B) are longitudinal sections showing a state when the second hitting sound is created.
Figure 15B:
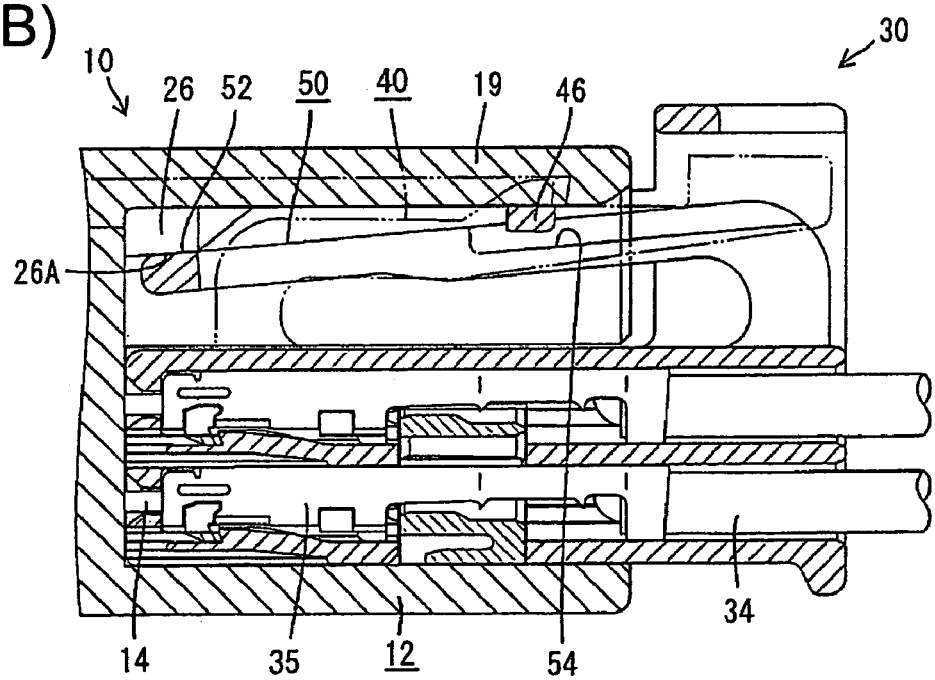

Subsequently, as shown in FIGS. 15(A) and 15(B), only the lock arm 40 is restored resiliently towards its initial posture while leaving the assisting piece 50 substantially as it is. This causes the first hitting portion 45 of the lock arm 40 to hit the first hittable portions 25. As a result, the second hitting sound is given out with a specified time difference. Simultaneously, the projection 42 of the lock arm 40 is fit into the lock groove 20 to effect locking.

According to this embodiment, the assisting piece 50 and the lock arm 40 hit the second hittable portions 26 and the first hittable portions 25 with a time delay to create at least two consecutive hitting sounds. The consecutive hitting sounds are more characteristic than a single hitting sound, an operator can judge whether locking has been properly effected by hearing the hitting sounds even in a loud environment.

Further, a selected hitting timing can be achieved by adopting a construction in which the first and second hittable portions 25, 26 are set at different heights.

A third embodiment of the invention is described with reference to FIGS. 16 to 20. In the third embodiment, three consecutive hitting sounds are given out at selected time differences. The following description focuses mainly on differences from the second embodiment, and portions having similar or the same functions as in the second embodiment are identified by the same reference numerals but are not described in detail.

The third embodiment has a female housing 30 with an assisting piece 60 formed by left and right arms 61L and 61R. However, unlike the other embodiments, the extending ends of the arms 61L, 61R are not connected. Thus, the respective arms 61L, 61R can be deformed and resiliently restored independently of each other. A second hitting portion 62 is defined at the extending end of the left arm 61L when viewed from the front, whereas a third hitting portion 63 is defined at the extending end of the right arm 61R.

The third embodiment also has a male housing 10A with second and third hittable portions 65 and 66 that project from the inner surface of the back side of an upper wall 19 of an entrance space 17 at the right and left sides of a lock groove 20 when viewed from front. The second hittable portion 65 is disposed to be hit by the second hitting portion 62 and the third hittable portion 66 is disposed to be hit by the third hitting portion 63. Hittable surfaces 65A, 66A of the hittable portions 65, 66 are lower or more inward than the first hittable portion 25. Specifically the hittable surface 65A of the second hittable portion 65 is lower or more inward than the inner surface of the upper wall 19 by about the depth of the lock groove 20 and the hittable surface 66A of the third hittable portion 66 is even lower or more inward, i.e. lower or more inward than the inner surface of the upper wall 19 preferably by more than 1.3-times, more preferably by about 1.5-times the lock groove 20.

The third embodiment is similar to the second embodiment in that the hittable surfaces 65A, 66A of the second and third hittable portions 65, 66 are inclined slightly down towards the back so as to be brought into surface contact with the mating second and third hitting portions 62, 63. Notches 27 are formed in inner areas of the front surfaces of both hittable portions 65, 66 to let the base end of a lock arm 40 escape. Slanted surfaces 28 are defined at outer areas of the front surfaces of the hittable portions 65, 66 to avoid interference with the second or third hitting portions 62, 63 of the assisting piece 60 before the resilient deformation.

Figure 16A:
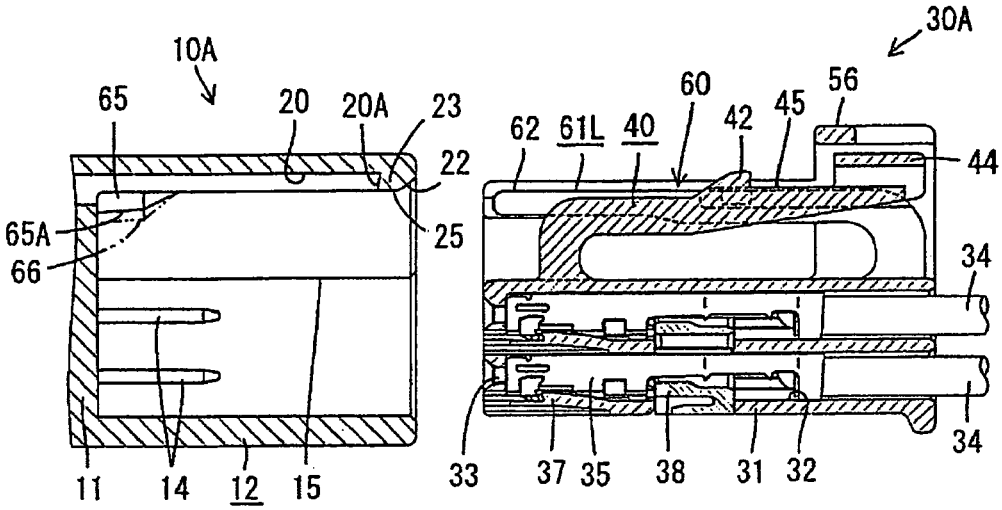
FIGS. 16(A) and 16(B) are longitudinal sections of male and female housings of a second embodiment of the invention prior to connection.
Figure 16B:
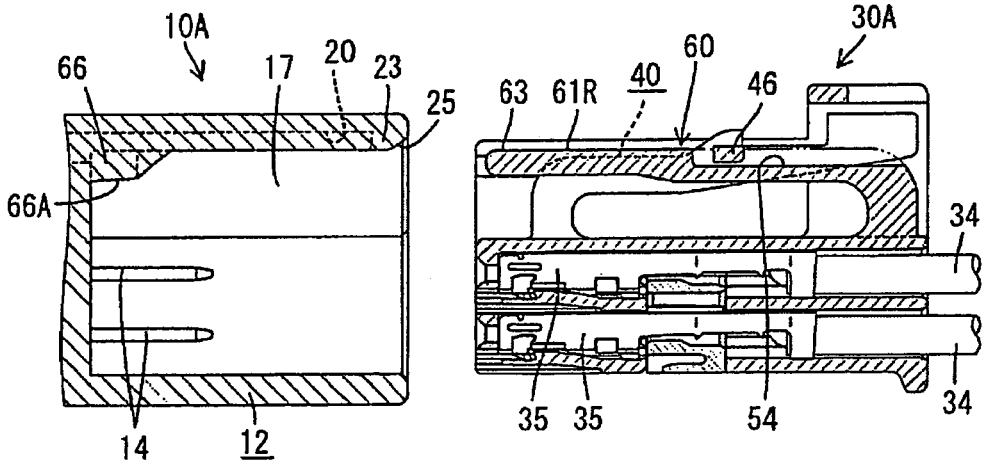
Figure 17:
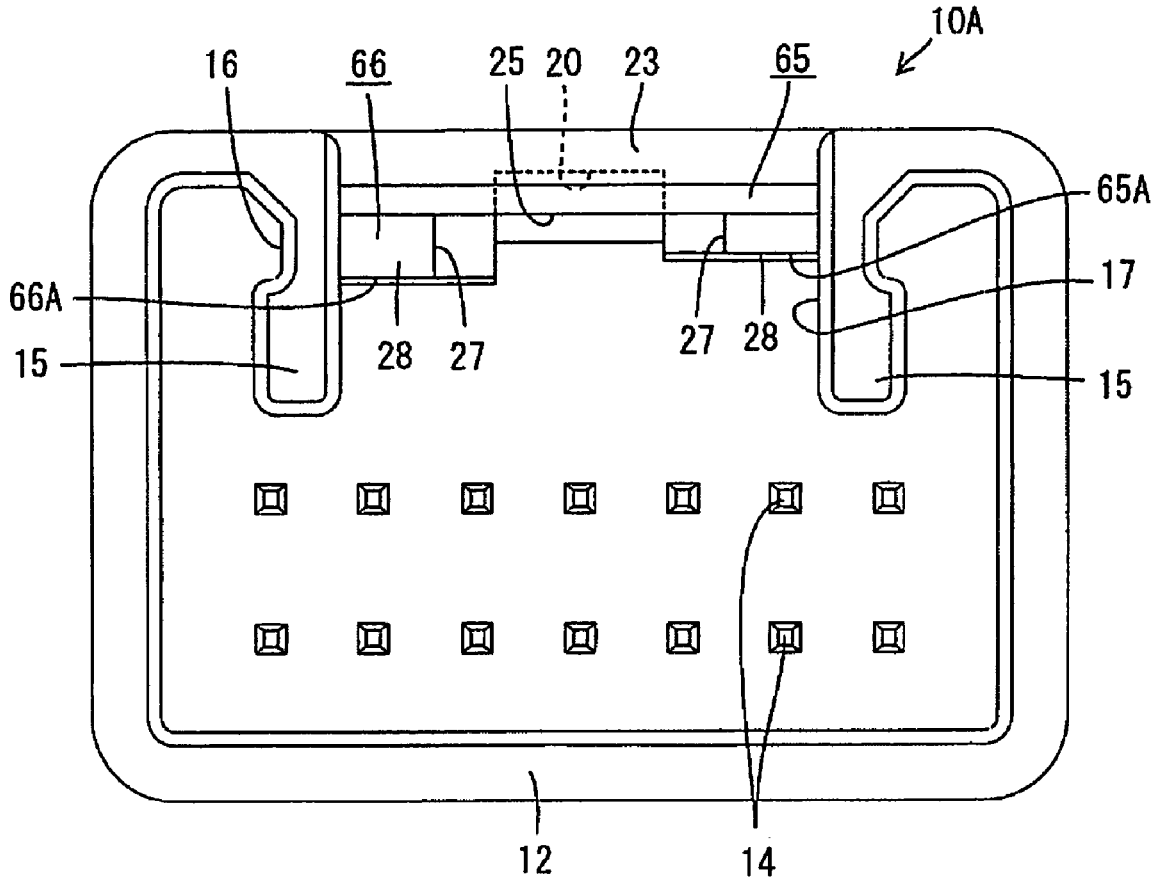
FIG. 17 is a front view of the male housing.
Figure 18:
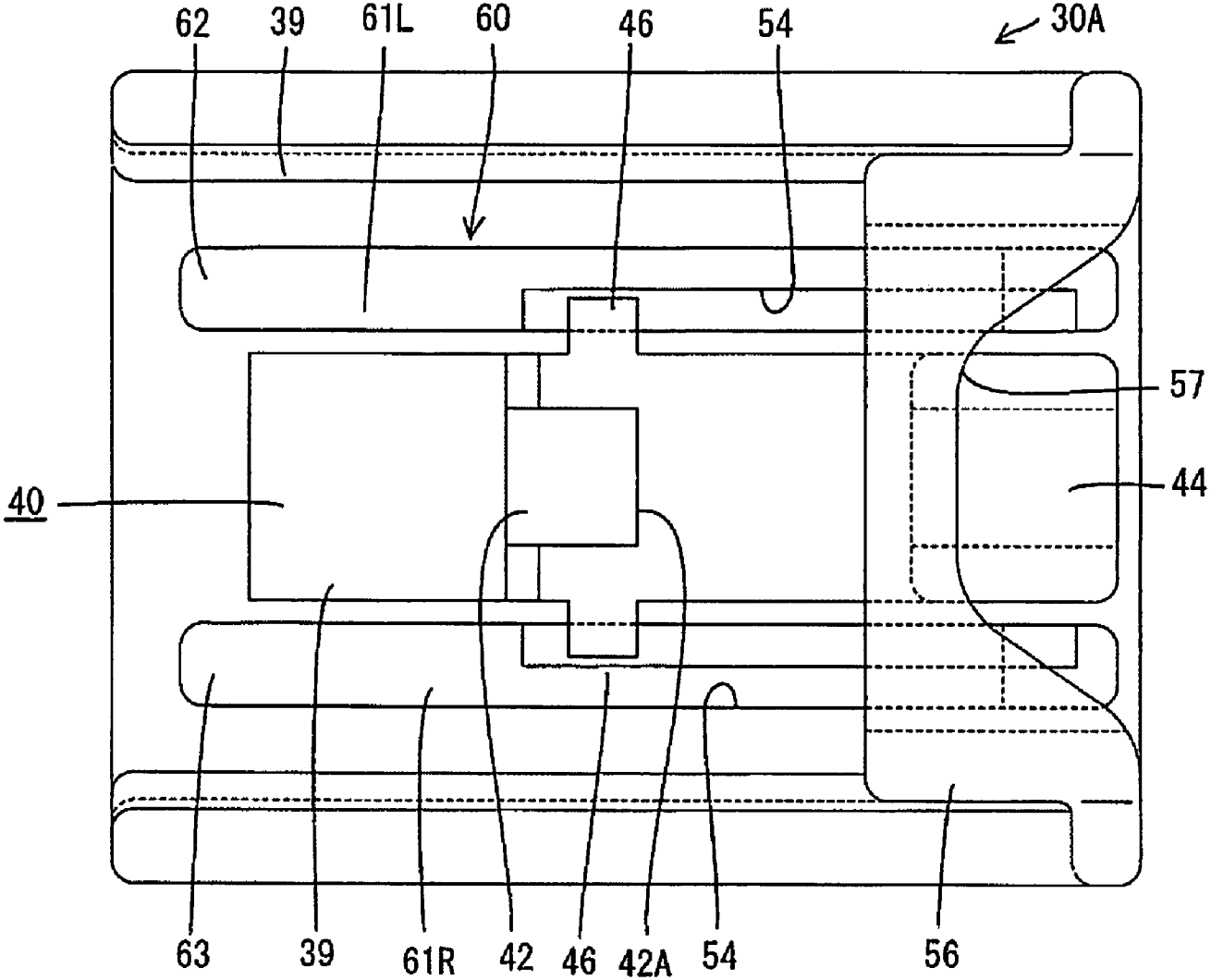
FIG. 18 is a plan view of the male housing.
Figure 19:
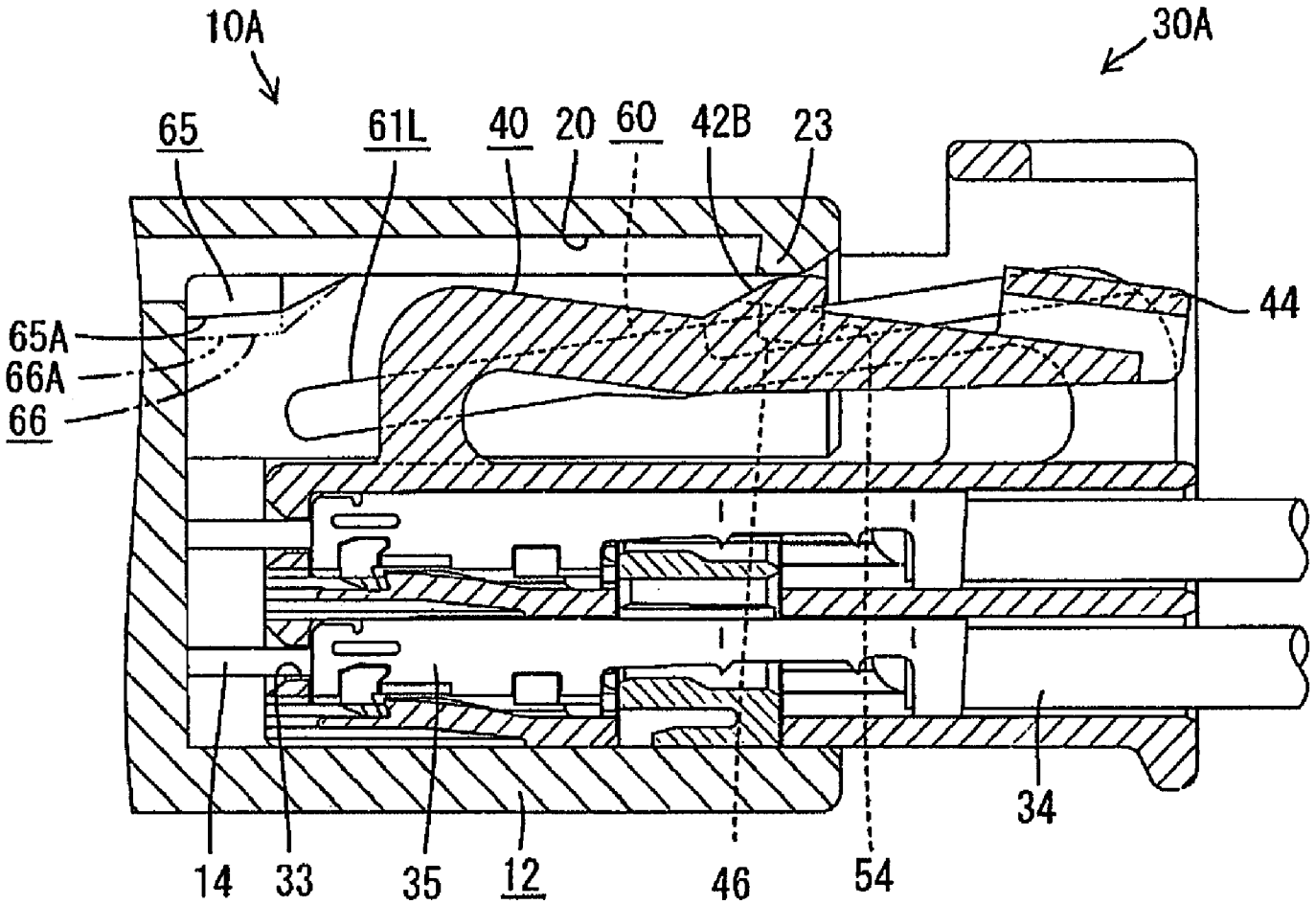
FIG. 19 is a longitudinal section showing an intermediate state during a connecting operation of the two housings.

The female housing 30A is fit into a receptacle 12 of the male housing 10A in a state shown in FIG. 16. A projection 42 of the lock arm 40 moves onto the lower surface of a front portion 23 of the lock groove 20, as the connecting operation approaches its final stage, as shown in FIG. 19. Thus, the lock arm 40 is pushed while the side of an operable portion 44 is deformed resiliently down. This causes pressing portions 46 of the lock arm 40 to press the bottoms of pressable grooves 54 in the respective arms 61L, 61R of the assisting resilient piece 60. As a result, the leading ends of both arms 61L, 61R simultaneously deform resiliently down.

The projection 42 of the lock arm 40 passes the lower surface of the front portion 23 when the two housings 10A, 30A are connected properly. Thus, the lock arm 40 and both arms 61L, 61R of the assisting piece 60 resiliently restore simultaneously towards their initial postures.

Figure 20A:
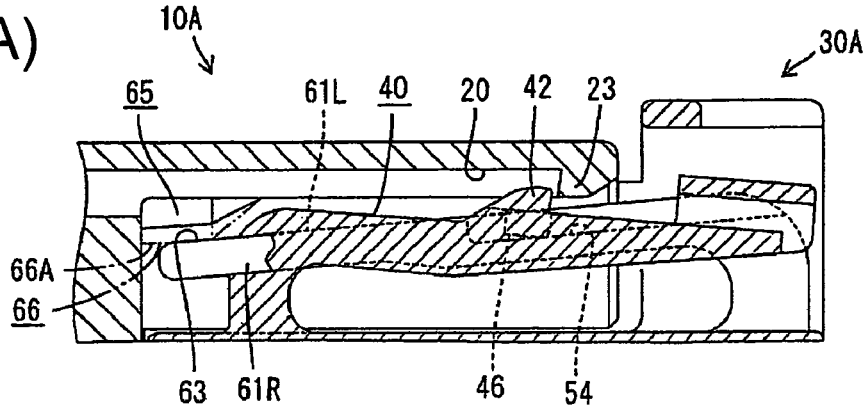
FIGS. 20(A), 20(B) and 20(C) are longitudinal sections showing the process of creating hitting sounds.
Figure 20B:
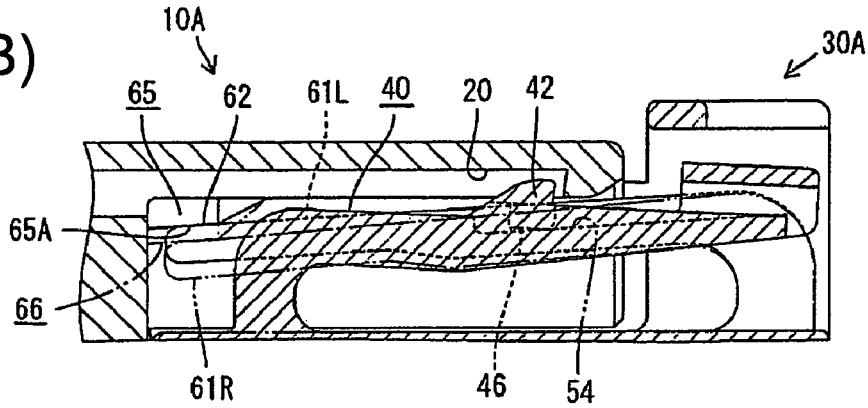

Then, as shown in FIG. 20(A), the third hitting portion 63 of the right arm 61R of the assisting piece 60 hits the hittable surface 66A of the third hittable portions 66 at the lowest position to produce the first hitting sound. Subsequently, as shown in FIG. 20(B), the left arm 61L and the lock arm 40 continue to return resiliently while leaving the right arm portion 61R as it is. The second hitting portion 62 of the left arm 61L then hits the hittable surface 65A of the second hittable portion 65 at the second lowest position to produce the second hitting sound.

Figure 20C:
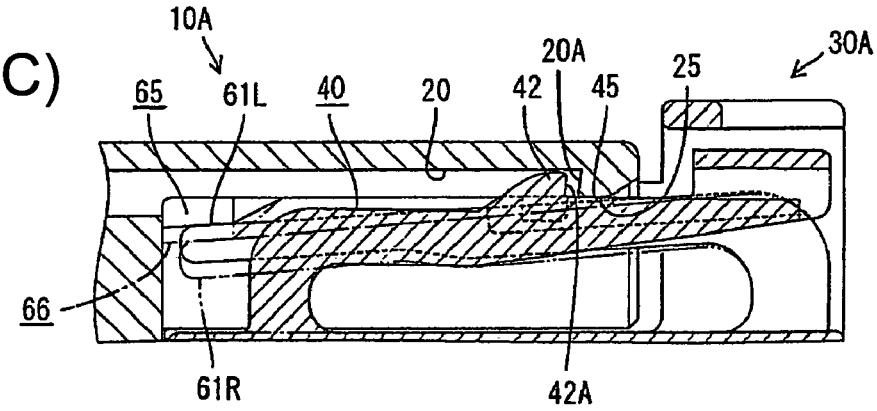

Finally, as shown in FIG. 20(C), the lock arm 40 is restored resiliently to its initial posture while leaving both arms 61L, 61R of the assisting piece 60 as they are. This causes the first hitting portion 45 of the lock arm 40 to hit the first hittable portion 25 to produce the third hitting sound. Simultaneously, the projection 42 of the lock arm 40 fits into the lock groove 20 to effect locking.

In the third embodiment, three consecutive hitting sounds are produced, including the one produced by the lock arm 40, to provide more distinctive audible and tactile indications of connection.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The lock arm and the assisting piece may be in the male housing.

The assisting piece and the lock arm may be in different housings.

To synchronize the hitting timings of the lock arm and the assisting piece, the first hitting portion of the lock arm and the second hitting portion of the assisting piece may be at substantially the same height and the second hittable portion for the assisting piece may be higher than the first hittable portion for the lock arm.

The invention is applicable to connectors with a seesaw-type lock arm that swings about a longitudinally intermediate point.

Although the male housing is connected with equipment in the foregoing embodiment, the housing may be connected with a wiring harness.

Although the terminal fittings are locked doubly in the illustrated embodiments, they may be locked singly either by the locks or the retainer.

Four or more hitting sounds can be produced, for example, by increasing the number of arms of the assisting piece.

What is claimed is:

1. A connector, comprising:

a housing for connection with a mating housing;

a resiliently deformable lock arm in the housing, the lock arm being deformed in the process of connecting the housing with the mating housing and being resiliently restored upon reaching a specified position for engaging an engaging portion in the mating housing to effect locking while hitting the mating housing; and at least one resilient assisting piece in one of the housings, the assisting piece being resiliently deformable as the lock arm is deformed, and being resiliently restorable together with the lock arm for hitting a mating hittable portion at one or more specified timings with respect to the hitting of the lock arm against the mating housing.

2. The connector of claim 1, wherein the assisting piece hits the mating hittable portion substantially simultaneously with the hitting of the lock arm against the mating housing.

3. The connector of claim 1, wherein the assisting piece is on the mating housing and the hittable portion is provided in the housing.

4. The connector of claim 1, wherein the assisting piece is substantially U-shaped and has two lateral arms coupled by an assisting hitting portion.

5. The connector of claim 4, wherein the arms cantilever from the mating housing at a position near an extending end of the lock arm and extend substantially along lateral sides of the lock arm to a position beyond a base end of the lock arm.

6. The connector of claim 1, wherein two partition walls are provided one of the housings, the lock arm and the assisting piece being at least partly between the partition walls.

7. The connector of claim 1, the assisting piece is capable of hitting the mating housing with a time difference from the hitting of the lock arm against the mating housing.

8. The connector of claim 7, wherein a hittable portion to be hit by the lock arm and a hittable portion to be hit by the assisting piece project different distances from a wall of the mating housing.

9. The connector of claim 7, wherein at least two independent assisting pieces are provided and hit the mating housing with time differences from each other.

10. A connector, comprising a housing with opposite front and rear ends, a resiliently deformable lock arm cantilevered from the housing and extending substantially in a front to rear direction on the housing, a pressing piece extending transversely from the lock arm, at least one resiliently deformable assisting piece formed on the housing and extending substantially parallel to the lock arm the assisting piece being cantilevered in a direction substantially opposite to a cantilevered direction of the lock arm, at least a portion of the assisting piece being between the pressing portion and the housing so that resilient deformation of the lock arm causes the pressing piece to deform the assisting piece, and so that resilient restoration of the assisting piece assists resilient restoration of the lock arm and produces a larger hitting sound of the lock arm against a mating housing.

11. The connector of claim 10, wherein the lock arm is cantilevered rearwardly from the front end of the housing and wherein the assisting piece is cantilevered forwardly from the rear end of the housing.

12. The connector of claim 11, wherein the at least one assisting piece comprises first and second assisting pieces disposed respectively on opposite respective sides of the lock arm.

13. A connector assembly, comprising:

a first housing formed with an engaging portion;

a second housing for connection with the first housing;

a resiliently deformable lock arm in the second housing, the lock arm being disposed for deforming in the process of connecting the second housing with the first housing and being resiliently restored upon reaching a specified position for engaging the engaging portion in the first housing to effect locking while hitting the first housing; and at least one resilient assisting piece in the second housing, the assisting piece being resiliently deformable as the lock arm is deformed, and being resiliently restorable together with the lock arm for hitting a mating hittable portion on the first housing.

14. The connector of claim 13, wherein the assisting piece hits the mating hittable portion substantially simultaneously with the hitting of the lock arm against the first housing.

15. The connector of claim 13, wherein the assisting piece is substantially U-shaped and has two lateral arms coupled by an assisting hitting portion.

16. The connector of claim 15, wherein the arms cantilever from the second housing at a position near an extending end of the lock arm and extend substantially along lateral sides of the lock arm to a position beyond a base end of the lock arm.

17. The connector of claim 13, the assisting piece is configured of hitting the first housing with a time difference from the hitting of the lock arm against the first housing.

18. The connector of claim 17, wherein a hittable portion to be hit by the lock arm and a hittable portion to be hit by the assisting piece project different distances from a wall of the first housing.

19. The connector of claim 13, wherein at least two independent assisting pieces are provided and hit the first housing with time differences from each other.

* * * * *